United States Patent [19]

Dudrey

[11] 4,253,436

[45] Mar. 3, 1981

[54] FUEL ADDITIVE SYSTEM FOR VEHICLES

[76] Inventor: Lawrence L. Dudrey, Rte. 1, Box 165, Hartford, Kans. 66854

[21] Appl. No.: 50,964

[22] Filed: Jun. 21, 1979

[51] Int. Cl.[3] ..... F02M 43/00

[52] U.S. Cl. ..... 123/198 A; 123/1 A; 261/18 A

[58] Field of Search ..... 123/198 A, 1 A, 510, 123/512, 575, 576, 577, 578, 25 A, 25 E, 25 R; 261/18 A

[56] References Cited

U.S. PATENT DOCUMENTS

| | | | |
|---|---|---|---|
| 4,068,639 | 1/1978 | Cook | 123/198 A |
| 4,096,829 | 6/1978 | Spears | 123/198 A |
| 4,161,160 | 7/1979 | Hicks et al. | 123/198 A |

*Primary Examiner*—Charles J. Myhre
*Assistant Examiner*—R. A. Nelli
*Attorney, Agent, or Firm*—Fishburn, Gold and Litman

[57] ABSTRACT

A liquid fuel and additive mixing apparatus for accurately proportioning the liquid additive into the liquid fuel for a vehicle such as a truck tractor includes a control unit preferably located in the cab of the truck tractor and connected to the vehicle electrical system for supplying electrical power thereto. A pump unit mounted to the truck tractor has an additive reservoir, pump, and valve controlled pressure delivery connections with the fuel tank and electrical connections with the control unit. When a known quantity of fuel is put into the truck tractor fuel tanks, the quantity is entered in the control unit and the control unit is activated to energize the pumps and open the valves for delivery to the fuel tanks of the predetermined quantity ratio of additive to the quantity of fuel put in the fuel tank. The pump is a constant output pressure pump and a nozzle orifice in the delivery connections between the valves and the fuel tanks is of a size that with a predetermined pressure, the orifice will deliver a certain quantity of additive each minute to the respective tanks for accurate proportioning of the additive and fuel therein.

8 Claims, 4 Drawing Figures

FUEL ADDITIVE SYSTEM FOR VEHICLES

This invention relates to mixing and proportioning devices and particularly to such devices for dispensing or injecting a desired amount of fuel additive into the fuel tank of a vehicle.

Selected additives, when properly mixed with the fuel in vehicle fuel tanks result in improved atomization of fuel for greater engine efficiency to add power and reduce fuel costs, inhibit freezing of fuel, maintain fuel injectors and carburetors clean, reduce carbon and varnish deposits in the engine, and generally reduce engine wear. Heretofore, the additives have generally been dispensed manually into the vehicle fuel tank by adding measured amounts of additive thereto. This method is time consuming and often comprises a disagreeable task, particularly during inclement weather conditions. Accordingly, the task is often incompletely accomplished, if at all, and does not result in mixing in the proper proportions.

In view of the above, the principal objects of the present invention are: to provide an apparatus for automatically injecting precise proportional amounts of a liquid fuel additive to a vehicle liquid fuel tank; to provide such an apparatus including a control unit which can be mounted inside the cab of a truck tractor for the convenience of an operator/driver; to provide such an apparatus including a reservoir for containing a quantity of liquid fuel additive; to provide such an apparatus having a pump unit and delivery connections for routing the liquid fuel additive from the reservoir into a vehicle fuel tank; to provide such an apparatus having a control unit with suitable calibration and actuation means therein to cause valves in the pressure delivery connections to remain closed until a desired operating pressure in the delivery connection is reached in order to insure accurate proportioning of the liquid additive to the delivery connection; to provide such an apparatus which can be later checked by supervisory personnel for determining that the operator/driver caused the liquid additive to be added to the vehicle fuel; and to provide such an apparatus which is relatively inexpensive, highly reliable in use and well adapted for its intended purpose.

Other objects and advantages of this invention will become apparent from the following description taken in connection with the accompanying drawings wherein are set forth, by way of illustration and example, a certain embodiment of this invention.

Figure 1:
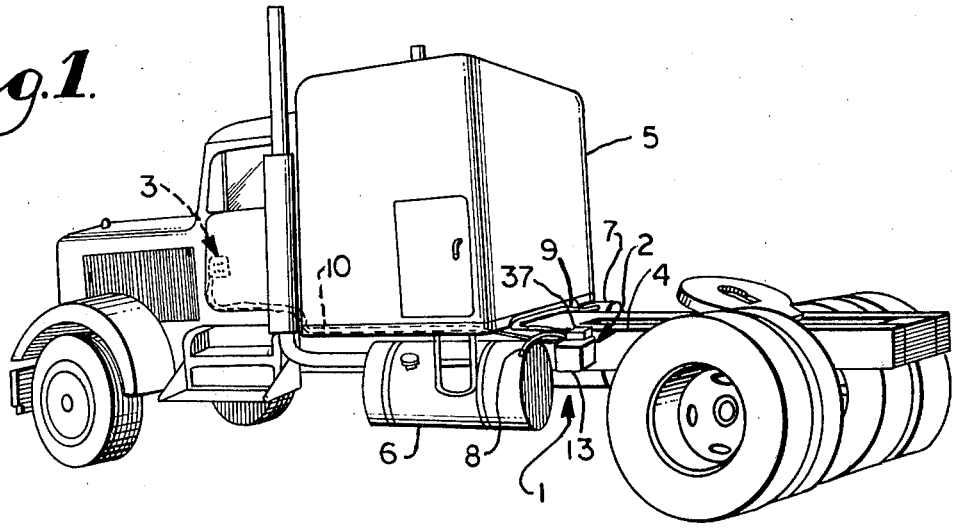
FIG. 1 is a perspective view of a vehicle or truck tractor and having an additive dispensing apparatus embodying the present invention mounted thereto.

As required, a detailed embodiment of the present invention is disclosed herein, however, it is to be understood that the disclosed embodiment is merely exemplary of the invention which may be embodied in various forms. Therefore, specific functional and structural details disclosed herein are not to be interpreted as limiting, but merely as a basis for the claims and as a representative basis for teaching one skilled in the art to variously employ the present invention in virtually any appropriately detailed structure.

Referring more in detail to the drawings:

The reference numeral 1 generally indicates an additive dispensing apparatus including a pump unit 2 and a control unit 3. The fuel additive or conditioner tends to improve fuel atomization, prevent freezing, improve top cylinder lubrication and the like. The pump unit 2 may be installed in any suitable location in or on a vehicle and is illustrated mounted on a rear frame beam 4 of a vehicle, such as a truck tractor 5 having fuel tanks such as saddle tanks 6 and 7 mounted thereto. The control unit 3 is preferably located in the cab of the vehicle and connected to the electrical system for supply of electrical power thereto. The pump unit 2 has an additive reservoir means 13, pump means 40 and valve controlled pressure delivery connections 8 and 9 with the fuel line and connections 10 with the control unit 3.

When a known quantity of fuel is put into the vehicle fuel tanks, the quantity is entered in the control unit 3 and then the control unit is activated to energize the pump 40 and open the valves for delivery to the fuel tank of the predetermined quantity and ratio of additive to the quantity of fuel put in the fuel tank. In the structure illustrated, the vehicle is a truck tractor 5 with two fuel tanks such as saddle tanks 6 and 7 and the control unit 3, pump means 40, valves 61 and 62, and delivery connections 8 and 9 are arranged for proper delivery of additive to the respective fuel tanks 6 and 7 for accurate proportioning of the additive and fuel therein.

The vehicle or truck tractor 5, in the illustrated example, is of conventional construction and includes an engine, an electrical system, an operator cab and a fuel tank, such as the saddle tanks 6 and 7 for containing a quantity of fuel for the engine.

Figure 2:
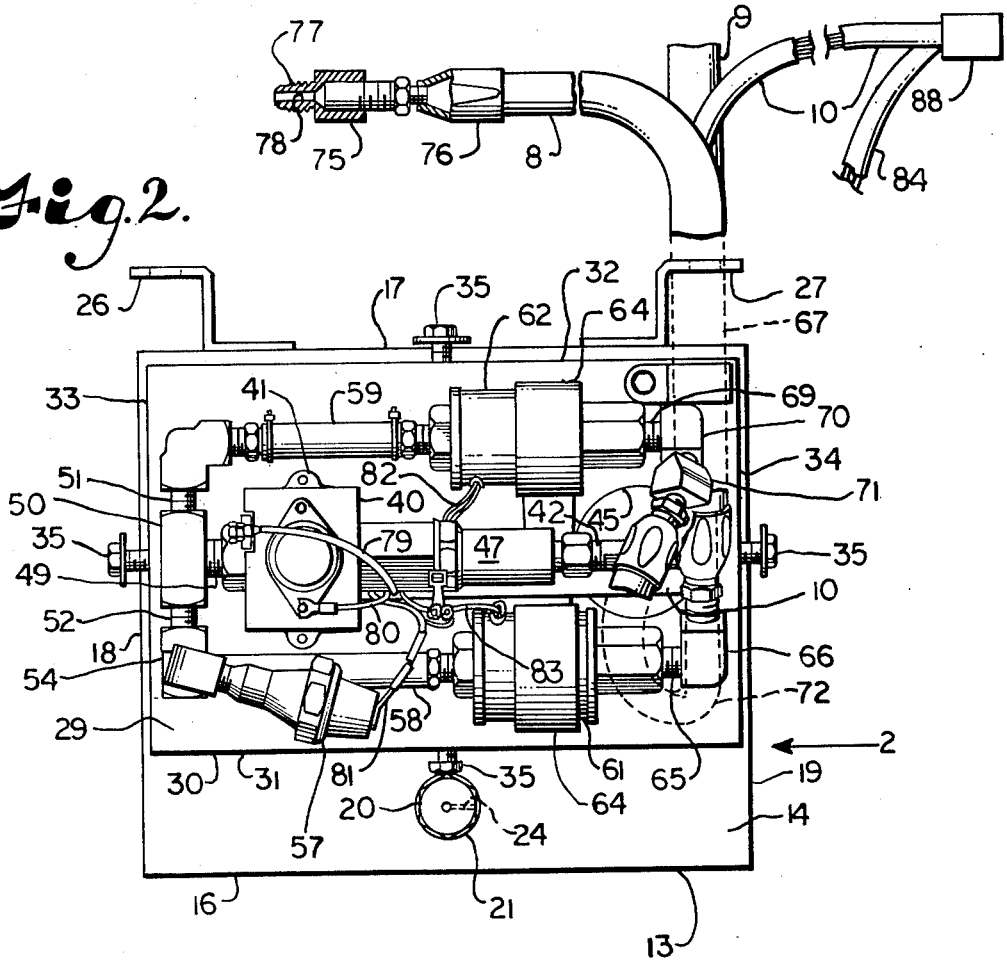
FIG. 2 is a top plan view of a pump unit of the additive dispensing apparatus.
Figure 3:
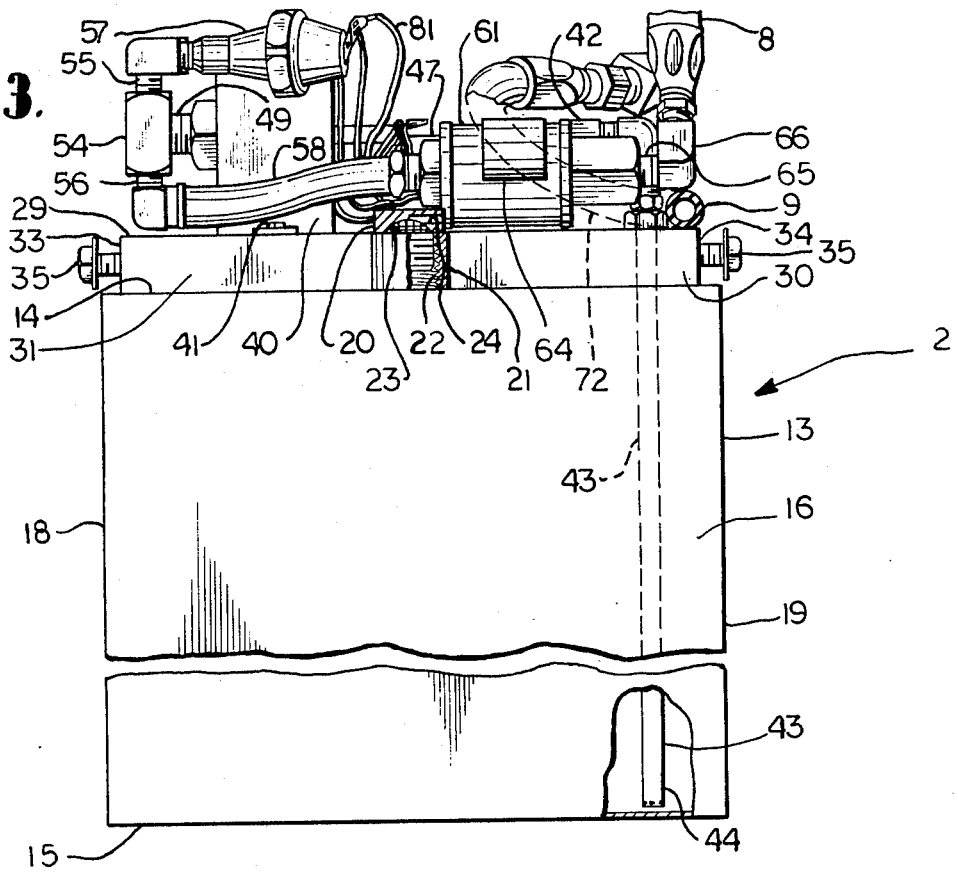
FIG. 3 is a front elevational view of the pump unit.

In the illustrated example, the pump unit 2 includes a reservoir means 13 mounted on the vehicle for containing a quantity of liquid additive that is a multiple of the quantity required for mixing with a full tank of fuel. The exemplary reservoir means 13 has top and bottom walls 14 and 15, front and rear walls 16 and 17, and opposite side walls 18 and 19. A removable cap 20 provides access to the reservoir means 13 and, in the illustrated example, the cap 20 is threadably mounted in a boss 21 extended outwardly from the top wall 14 and surrounding a filling port 22. The exemplary cap 20 has an internal screen 23 and a vent tube 24 providing communication between the exterior atmosphere and the reservoir means 13 for expansion and contraction of the liquid or fuel additive therein. The reservoir means 13 is suitably mounted to the rear frame beam 4 of the truck tractor 5, such as by L-shaped brackets 26 and 27, FIG. 2.

The apparatus 1 includes means for removing additive or conditioner from the reservoir means 13 and injecting a quantity thereof into the fuel tank 6 or 7 at a predetermined rate and time to proportion the additive or conditioner delivered to the fuel tank to fuel introduced therein. The additive injecting means include a pump means 40 arranged for drawing the additive or conditioner from the reservoir means 13, means controlling the output to a constant pressure and predetermined flow rate, a conduit from the pump outlet to the fuel tank and a control valve in the conduit controlling the period of flow of additive or conditioner injected into the fuel tank.

In the illustrated example, the reservoir means 13 has a mounting base or plate 29 overlying a rear portion of the top wall 14 and spaced from the cap 20 for accommodation of various means described below. A peripheral wall 30 extends around the mounting base or plate 29 and has front and rear wall portions 31 and 32 and opposite side wall portions 33 and 34, each of the wall portions having a fastener such a bolt 35 for mounting a protective cover 37, FIG. 1, over the mounting base or plate 29 to provide a secure, weather tight shield thereover.

In the illustrated example, the pump means 40 is driven by an electric motor integral therewith for constant pressure output and is suitably mounted, as by fasteners 41 atop the mounting base or plate 29. The pump means 40 is connected via an inlet conduit 42 to a suction tube 43 extending downwardly through an aperture 45 in the mounting base or plate 29 and the top wall 14 of the reservoir means 13. A lower end 44 of the suction tube 43 is positioned adjacent the interior surface of the bottom wall 15 for drawing liquid fuel additive or conditioner therethrough. As the additive or conditioner is drawn upwardly through the suction tube 43 and through the inlet conduit 42, the additive or conditioner passes through a filter 47 to remove particles and sediment therefrom and into the pump means 40.

To route the additive or conditioner from the pump means 40 to separate fuel tanks, such as the tanks 6 and 7, a primary outlet tube 49 is connected to a Tee-fitting 50 with opposite branching conduits 51 and 52. The conduit 52 is connected to a second tee-fitting 54 having opposite branching conduits 55 and 56 respectively connected to a pump output pressure sensor and transmitting device 57 and a conduit 58.

The primary outlet tube 49 splits into separate branches having conduits 58 and 59 extending toward the fuel tanks 6 and 7 and are respectively connected to control valves 61 and 62 which are solenoid actuated in the illustrated example. The control valves 61 and 62 are mounted by hemispherical brackets 64 to the mounting base or plate 29 and operate to open upon electrical actuation to permit the additive or conditioner to flow through the respective conduits.

Routing the additive or conditioner to the fuel tanks 6 and 7, a conduit 65 extends from the control valve 61 and is connected via a fitting 66 to the delivery connection or hose 8 leading to one of the fuel tanks 6 or 7. A conduit 69 extends from the control valve 62 and is connected via fittings 70 and 71 to the delivery connection or hose 9 leading to the remaining fuel tank 6 or 7.

Means control the pump output to a constant pressure and predetermined flow rate and in the exemplary structure, the means includes respective nozzles 75 mounted in the delivery connections or hoses 8 and 9. The nozzle 75 is connected to a fitting 76 and includes mutually confronting walls 77 forming an orifice 78 therethrough for controlling the flow of a additive or conditioner. The nozzle orifice 78 is of a size that with a predetermined pressure or output of the pump means 40, the apparatus 1 will deliver a certain quantity of additive per unit of time.

The nozzles 75 can be interchanged with similar nozzles each having an orifice of a selected different size to regulate delivery of a certain quantity of additives or conditioner per unit of time.

Figure 4:
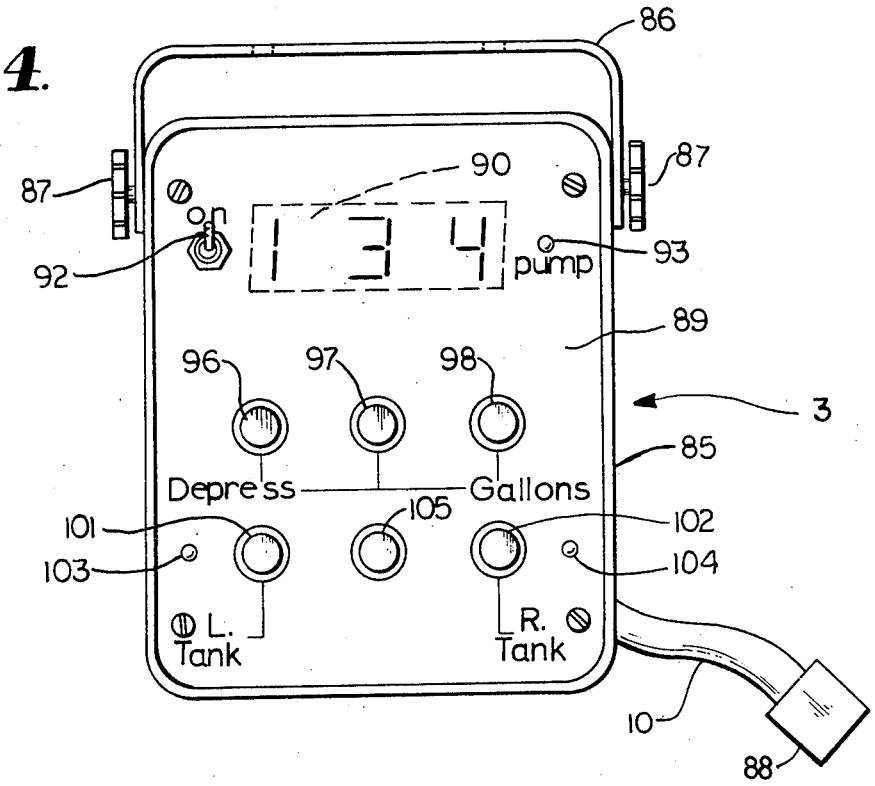
FIG. 4 is a front elevational view of a control unit for the additive dispensing apparatus.

The pump unit 2 is suitably connected by electrical lines to the control unit 3 and includes a plurality of individual electrical lines respectively connected to the pump means 40, the pressure sensor and transmitting device 57 and the control valve 61 and 62. In the illustrated example, the electrical lines form a bundle 10 which extends generally under the filter 47, between the control valves 61 and 62 and with lines 79 and 80 connected to the pump means 40. An electrical line 81 is connected to the pressure sensor transmitting device 57 and electrical lines 82 and 83 are respectively suitably connected to the control valves 61 and 62 for proper operation thereof. The electrical lines may have quick disconnect fittings 88 with respective male and female portions, FIGS. 2 and 4.

The apparatus 1 includes means for automatically controlling the delivery of the additive or conditioner to the fuel tanks 6 and 7 and includes means for operating the pump means 40 and the valves 61 and 62 and a timing means set in accordance with the quantity of fuel introduced into the fuel tanks 6 and 7 whereby operation of the pump means 40 and operation of the valves 61 and 62 is limited to a proportional time period for injecting the quantity of additive that is proportional to the quantity of fuel introduced into the fuel tanks 6 and 7. In the illustrated example, the control unit 3 is connected to the vehicle electrical system by a suitable power line 84 which connects to the quick disconnect fitting 88 in FIG. 2, and has a rectangular housing 85 detachably and pivotally connected to a mounting bracket 86 as by fasteners 87.

The control unit 3 is arranged to indicate the quantity of fuel to which additive is to be delivered by a proportional time of operation. When the indicated quantity of fuel added to the fuel tank is reduced to zero, the circuit to the pump means 40 and the valves 61 and 62 is interrupted to stop further delivery of the additive. The exemplary control unit 3 has a front face 89 having a portion thereof of dark, shaded Plexiglas through which a LED (light emitting diode) display 90 appears as described below. A switch 92 on the front face 89 routes electrical power to energize circuitry within the control unit 3.

Suitable internal calibration circuitry with the control unit 3 includes a timing means calibrated in liquid measuring units whereby when a total of the measuring units of the fuel introduced into the fuel tank 6 and 7 is set forth therein, the timing means will limit the opening of the valves 61 and 62 to a time period during which a proportional quantity of additive or conditioner is injected into the fuel tanks 6 and 7.

For this purpose, the display 90 registers the amount of fuel added to the fuel tanks in liquid measuring units, such as gallons. Three button-type or press switches are positioned generally below the respective digits of the display 90 and includes switches 96, 97 and 98 for respectively setting numerals therein. The switches 96, 97 and 98 are actuated by holding same in a depressed position and the display digits will increase numerically until the desired number is reached. The switch is then released and the appropriate numeral remains illuminated. If the switch 96, 97 or 98 is held depressed too long and the desired numeral passes, the reset should be depressed to return the digits to zero.

Fuel tank switches 101 and 102 respectively route electrical power to first energize the pump means 40 and illuminate a light 93 on the control unit 3. After actuating the tank switches 101 and 102, the control valves 61 and 62 selectively open and lights 103 and 104 adjacent to the switches 101 and 102 illuminate when the appropriate valve is open. The timing means of the control unit 3 provides a delay, such as approximately five seconds, after the tank switches 101 and 102 are actuated before the appropriate control valve opens to insure proper pump output pressure prior to pump operation for proper operation of the nozzles 75.

A reset button 105 is provided for resetting the calibration circuit of the control unit 3 back to zero. Should the pressure sensor and transmitting device 57 indicate a noflow condition, as when the additive or conditioner in the reservoir means 13 is depleted, an indication thereof comprises, in the illustrated example, the numerals "888" appear alternately on the display 90 with the count down cycle.

In the use of the additive dispensing apparatus 1, the truck tractor driver/operator, after filling the vehicle fuel tanks, enters the amount of fuel added to the tank in the appropriate liquid measuring units, such as gallons, into the control unit 3. In the illustrated example, 134 gallons of fuel has been added to a selected fuel tank 6 or 7 and, by depressing the appropriate switches 96, 97 and 98, the numerals "134" have been entered on the display 90. At the time of fuel servicing, the driver/operator should also insure that the reservoir means 13 is filled with fuel additive or conditioner by removing the cap 20 and checking therein.

The driver/operator then uses the switch 92 to energize the control unit. By depressing switches 96, 97 and 98 the number of gallons in the tank is indicated. The operator next depresses an appropriate fuel tank switch 101 or 102 to energize the light 93 and the pump means 40, routing electrical power to the pump unit 2 and the control valve 61 or 62 to open and direct the additive or conditioner through the hoses to the nozzles 75. The constant output pressure of the pump means 40 provides a desired quantity of additive or conditioner each minute delivered to the respective nozzle orifices 78 which control and proportion the amount of additive or conditioner delivered to the tanks 6 and 7. The additive or conditioner is directed through the hoses 8 and 9 into the fuel tanks 6 and 7 and is injected under pressure thereinto for mixing with the fuel added to the tanks 6 and 7 in the proper proportion therewith.

As the additive or conditioner is injected into the fuel tanks, the numerals in the display 90 decrease sequentially and indicate the remaining liquid measuring units of fuel for which the proper portion of additive is needed. The calibration circuit within the control unit 3 provides proper timing or metering to correlate the output pressure of the pump 40 and the pressurized flow through the orifices 78 to achieve a proportion of additive dispensed relative to the amount of fuel added to the fuel tank. The pump means 40 is automatically de-energized by the control unit 3 when the proper amount of additive or conditioner has been delivered to the selected fuel tank.

The procedure is repeated for the remaining fuel tank to automatically inject the additive or conditioner into the fuel therein.

It is to be understood that while one form of this invention has been illustrated and described, it is not to be limited to the specific forms or arrangement of parts herein described and shown, except insofar as such limitations are included in the following claims.

What is claimed and desired to secure by Letters Patent is:

1. A liquid fuel and additive mixing apparatus for accurately proportioning the liquid additive into the liquid fuel for a vehicle and the like, comprising:

(a) a vehicle having an engine, an electrical system, an operator cab and a fuel tank for containing a quantity of fuel for the engine;

(b) a reservoir means mounted on the vehicle for containing a quantity of liquid additive which is a multiple of the quantity thereof required for mixing with a full tank of fuel;

(c) means for removing said additive from the reservoir means and injecting a quantity thereof into the fuel tank at a predetermined rate and time to proportion said additive delivered to the fuel tank relative to fuel introduced therein; said additive injecting means including pump means arranged for drawing additive from the reservoir means, means for controlling the pump output to a constant pressure and predetermined flow rate, a conduit from a pump outlet to the fuel tank, and a control valve in said conduit controlling the period of flow of additive injected into the fuel tank; and (d) means for automatically controlling delivery of said additive to the fuel tank and including means for operating said pump means and said valve and including a timing means set in accordance with the quantity of fuel introduced into the fuel tank whereby operation of the pump means and opening of the valve is limited to a proportional time period for injecting the quantity of additive which is proportional to the quantity of fuel introduced into the fuel tank.

2. The liquid fuel and additive mixing apparatus set forth in claim 1 wherein:

(a) said means controlling the pump output and flow rate is a constant pressure pump and an orifice in said conduit whereby the rate of injection of said additive is a predetermined quantity per interval of time.

3. The liquid fuel and additive mixing apparatus set forth in claim 2 wherein:

(a) said timing means is calibrated in liquid measuring units whereby, when set for a total of said liquid measuring units of the fuel introduced into the fuel tank, said timing means operates to limit the opening of said valve for a time period during which a proportionate quantity of additive is injected into the fuel tank.

4. The liquid fuel and additive mixing apparatus set forth in claim 3 wherein:

(a) said means for operating said pump means and said valve includes delay means for delaying the opening of said valve a sufficient period of time after operating said pump means to insure the delivery of said additive at a constant pressure and predetermined flow rate from said pump means.

5. The liquid flow and additive mixing apparatus set forth in claim 4 including:

(a) a pump output pressure transmitter device in said conduit for sensing the pressure of the additive therein; and wherein (b) said pressure transmitter device indicates failure of additive flow due to an empty reservoir.

6. The liquid flow and additive mixing apparatus set forth in claim 1 wherein:

(a) said control valve is solenoid operated and de-energized to a closed position stopping the flow of additive to the fuel tank; and (b) said pump means includes an electric motor operating same, said electric motor being de-energized to stop output of said pump means.

7. The liquid flow and additive mixing apparatus set forth in claim 1 wherein:

(a) said pump means, and said control valve are mounted atop said reservoir means; and including (b) a cover protectively mounted on said reservoir means and enclosing said pump means and said control valve.

8. A liquid fuel and additive mixing apparatus for accurately proportioning the liquid additive into the liquid fuel for a vehicle and the like, comprising:

(a) a vehicle having an engine, an electrical system, an operator cab and a fuel tank for containing a quantity of fuel for the engine;

(b) a reservoir mounted on the vehicle for containing a quantity of liquid additive which is a multiple of the quantity thereof required for mixing with a full tank of fuel;

(c) a constant pressure pump arranged for removing said additive from the reservoir and injecting a quantity thereof into the fuel tank at a predetermined rate and time to proportion said additive delivered to the fuel tank relative to fuel introduced therein; said pump connected to a pressure transmitter device for sensing output pressure thereof, a conduit from a pump outlet to the fuel tank, a solenoid operated control valve in said conduit controlling the period of flow of additive injected into the fuel tank, and an orifice in said conduit of a size that with a predetermined pressure of said pump, said conduit will deliver a predetermined quantity of additive per interval of time;

(d) a control unit for automatically controlling delivery of said additive to the fuel tank and including an electrical circuit for operating the pump and said control unit including a timing means operable to delay opening of said valve for a set period of time until said additive is at a normal operating pressure in said conduit, said timing means being calibrated in liquid measuring units whereby, when set for a total of said liquid measuring units of the fuel introduced into the fuel tank, said timing means controls operation of said pump and opening of said control valve to limit the opening of said control valve for a proportional time period for injecting the quantity of additive which is proportional to the quantity of fuel introduced into the fuel tank.

* * * * *